United States Patent [19]

Rogers

[11] 4,031,644

[45] June 28, 1977

[54] PAGE-TURNERS

[75] Inventor: Peter Rogers, Addlestone, England

[73] Assignee: Possum Controls Limited, Aylesbury, England

[22] Filed: Apr. 12, 1976

[21] Appl. No.: 675,758

[30] Foreign Application Priority Data

Apr. 18, 1975 United Kingdom ..... 16174/75

[52] U.S. Cl. ..... 40/104 A; 84/487

[51] Int. Cl.[2] ..... G09F 11/00

[58] Field of Search ..... 40/104 A, 104 R, 343–346, 40/355, 356; 84/487, 486

[56] References Cited

UNITED STATES PATENTS

| | | | |
|---|---|---|---|
| 2,494,453 | 1/1950 | Reck | 40/104 A |
| 2,755,580 | 7/1956 | Justice | 40/104 A |
| 2,791,847 | 5/1957 | Hagman | 40/104 R |
| 3,087,268 | 4/1963 | Rice | 40/104 A |

*Primary Examiner*—John F. Pitrelli

*Attorney, Agent, or Firm*—Robert F. O'Connell

[57] ABSTRACT

Apparatus enabling the pages of a book to be turned by remote control comprises a book-support with a reversible electric motor on it. An output shaft of the motor extends across the book and the motor is pivotally mounted for swinging the shaft both across and perpendicular to the book through limited angles. A friction wheel is on the shaft for rolling across the pages of the book and a radial finger adjacent the friction wheel is coupled to the shaft through a slipping clutch.

4 Claims, 7 Drawing Figures

16
13
17
15
12
10
26
34
32
31
27
2
2
33
14
18
11
20
23
24
22
25
21

PAGE-TURNERS

The present invention relates to apparatus whereby the pages of a book can be turned by remote control. Such apparatus is required, for example, by people who are paralysed but can operate simple pneumatic controls by puffing or sucking on a pneumatic-control tube or, for example, if they are able to move a finger, by operating a simple control-switch arrangement.

According to the present invention there is provided apparatus whereby the pages of a book can be turned by remote control, comprising a mounting board or frame for supporting a book and having a reversible electric motor mounted thereon, the motor having an output shaft extending therefrom over and generally parallel to the mounting board or frame and being pivotally mounted for swinging of the output shaft through limited angles across and perpendicular to the mounting board or frame, the output shaft having affixed thereto a friction-wheel for rolling across the pages of a book resting on the mounting board or frame when the wheel is driven by the motor, and a radial finger adjacent the wheel and coupled to the shaft through a slipping clutch whereby when the shaft reaches a limit of swing across a book the wheel can continue its rotation with the finger held against rotation by engagement with the mounting board or frame.

The invention will now be described, by way of example, with reference to the accompanying drawings, in which.

Figure 1:
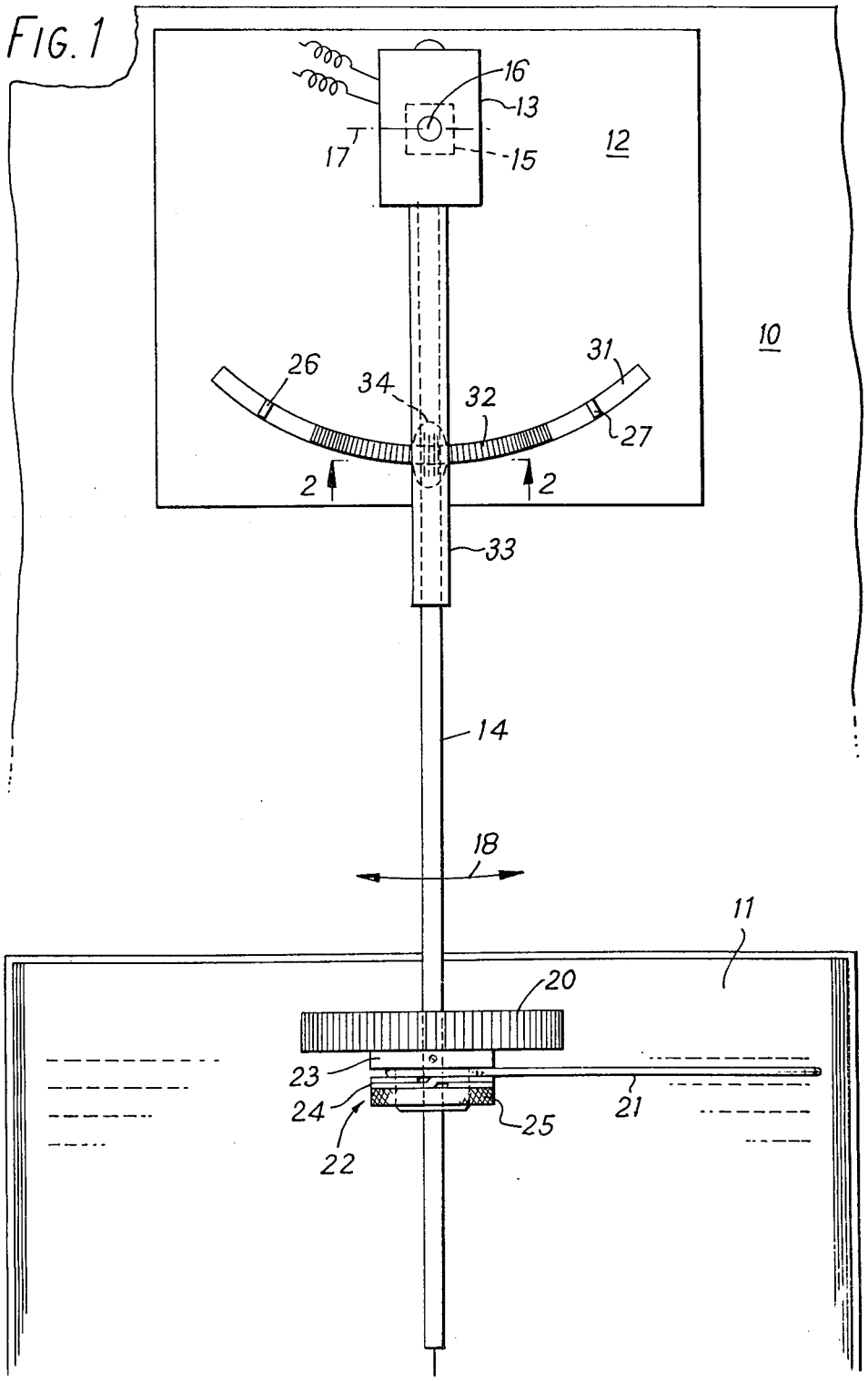
FIG. 1 is a schematic plan view of a page turned according to the invention with part of a mounting board and a book thereon cut away.
Figure 2:
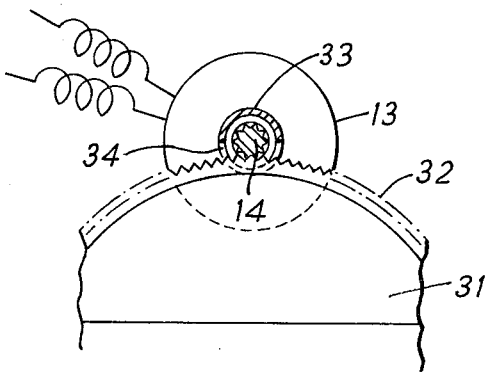
FIG. 2 shows a section taken at 2—2 in FIG. 1.
Figure 3:
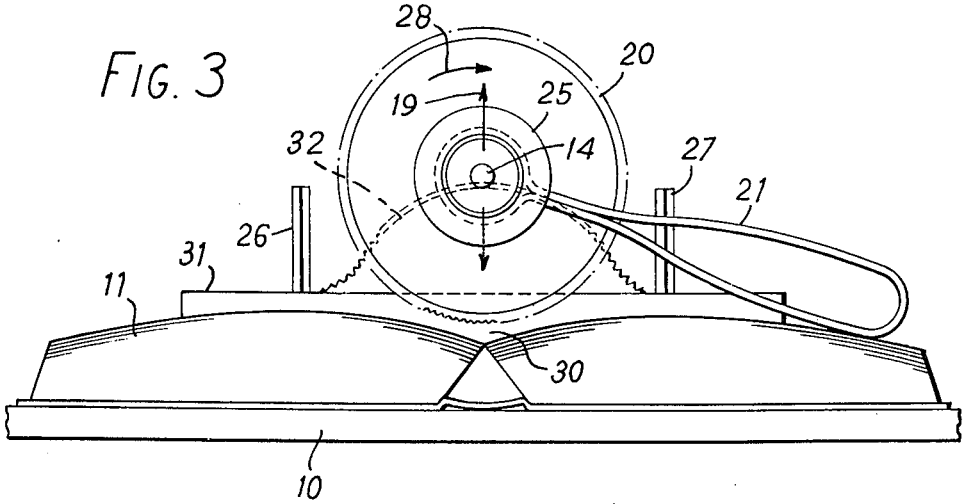
FIG. 3 shows an elevation of the apparatus of FIG. 1.

Referring to FIGS. 1 to 3, apparatus whereby the pages of a book can be turned by remote control comprises a mounting board or frame 10 for supporting a book 11. A sub-frame 12 carries a reversible electric motor 13 which has an output shaft 14 extending therefrom. The shaft 14 extends over and generally parallel to the board 10 and the motor 13 is mounted on the subframe 12 through a pivotal mounting shown dotted at 15. The pivotal mounting 15 permits the motor and its output shaft to swing about an axis 16 perpendicular to the board and permits the motor and its shaft to swing in directions perpendicular to the board about an axis 17 parallel to the board. The two directions of swing are indicated by the arrows 18 in FIG. 1 and 19 in FIG. 3.

A hard-rubber friction-wheel 20 with a milled edge is affixed to the output shaft 14 and a radial finger 21 is coupled to the shaft 14 adjacent the wheel 20 through a slipping clutch 22. The clutch can be of any suitable kind. In one example the finger 21 is in the form of a loop of steel wire and the inner end of the loop is urged against the boss 23 of the wheel 20 by a Belville washer 24 compressed by a knurled nut 25.

The swing of the motor 13 and its output shaft 14 across the board 10 is limited by two stops 26 and 27. A spring (not shown) urges the shaft 14 towards the board 10.

Referring to FIGS. 4 to 7, these show the manner in which the friction-wheel 20 and radial-finger 21 function in turning the page of a book.

Figure 4:
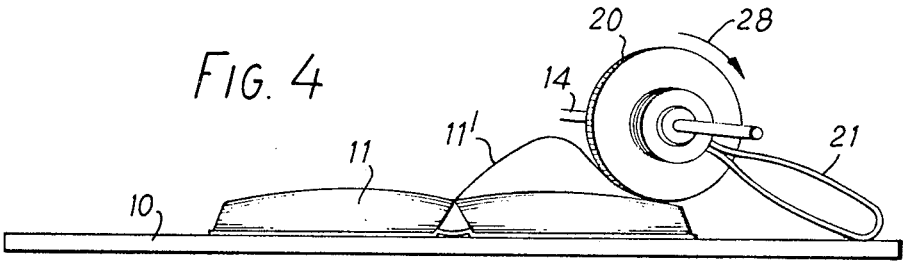
FIGS. 4 to 7 illustrate the manner in which the apparatus of FIGS. 1 to 3 operates.
Figure 5:
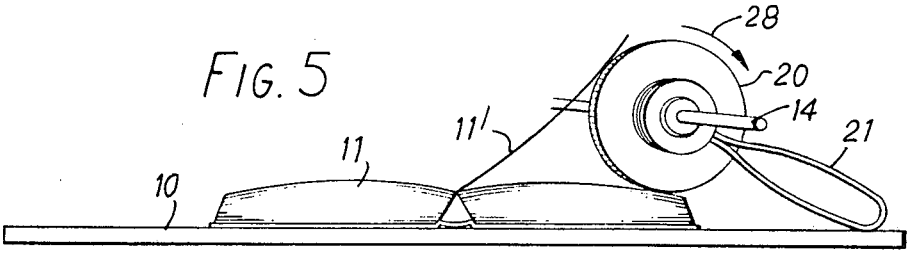

In FIG. 4 the wheel 20 is shown at one extreme of its swing across the book 11. When in this position the wheel 20 is kept turning in the direction of the arrow 28 which brings the finger 21 into engagement with the board 10. This prevents rotation of the finger 21 but continued rotation of the wheel 20 is permitted by the slipping clutch. This continued rotation of the stationary friction-wheel 20 in engagement with the uppermost right-hand page 11' of the book 11 causes this page to be arched upwardly as shown by leftward movement of the right-hand edge of the paper 11'. This in continued until the page 11' flops on top of the wheel 20 as shown in FIG. 5.

Figure 6:
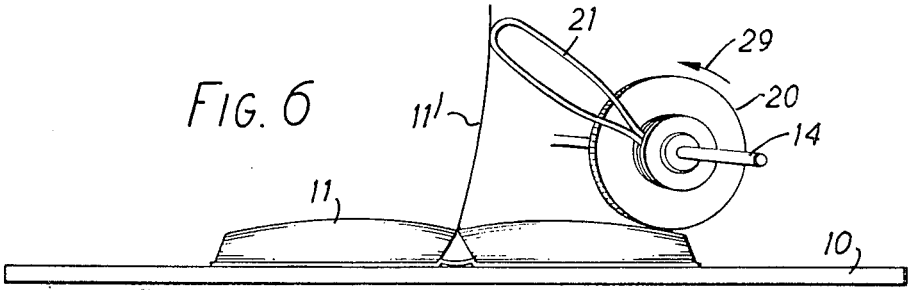
Figure 7:
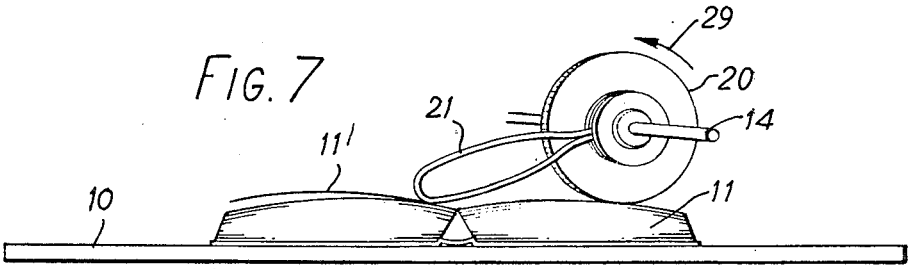

The direction of rotation of the motor is then reversed as indicated by the arrow 29 in FIG. 6. This causes the wheel 20 to move to the left by rolling over the book and causes the radial finger 21 to rotate anticlockwise with the wheel. In doing so the finger 21 pushes the raised page 11' over as indicated in FIGS. 6 and 7.

Thereafter the motor is kept energised until the wheel reaches the left-hand limit (the opposite to that shown in FIG. 6) when the motor is switched off before the wheel 20 begins to arch-up the page 11'.

It has been found that the valley 30 formed down the centre of an open book can cause erratic operation by slippage of the friction-wheel. To overcome this an upstanding arcuate member 31 is provided on the subframe 12. This arcuate member 31 carries the stops 26 and 27 to limit the angle of swing of the shaft 14 across the book 11. The stops are also made adjustable along the member 31 to enable satisfactory operation to be effected with different sizes of books.

The slippage problem is overcome by so raising the central region of the member 31 in a smooth curve as shown at 32 in FIG. 2 that the shaft 14 engages it and traction is provided by this engagement instead of by engagement between the wheel 20 and the book 11. This condition is shown in FIG. 2. The wheel 20 is shown held clear of the book 11 by engagement of the shaft 14 with the raised region 32 of the member 31. To facilitate traction the raised region 32 is preferably provided with a serrated rubber covering and the shaft with a correspondingly serrated periphery in the area of engagement.

To prevent wear of the stops 26 and 27 by the rotating shaft 14 and to provide support for the shaft 14, a tube 33 is fixed at one end to the motor 13 and is coaxial with the shaft. The shaft 14 rotates inside the tube 33 and a window 34 is provided in the tube to permit the shaft 14 to engage the central raised region 32 of the member 31.

The controls for the motor 13 will depend upon the method of operation to be used. If the puff and suck method is employed the operator puffs into a tube for rotating the motor in one direction and he sucks on the tube to reverse the direction of rotation. A known pneumatic switch or switches carry out the required switching of the motor supply. If push-button are used, one button can be depressed to drive the motor in one direction and the other can be pressed to reverse the motor.

I claim:

1. Apparatus whereby the pages of a book can be turned by remote control, comprising a mounting board for supporting a book and having a reversible electric motor mounted thereon, the motor having an output shaft extending therefrom over and generally parallel to the mounting board and being pivotally mounted for swinging movement of the output shaft through limited angles across and perpendicular to the mounting board, the output shaft having affixed thereto a friction-wheel for rolling across the pages of a book resting on the mounting board when the wheel is driven by the motor to thereby turn said pages, and a radial finger adjacent the wheel and coupled to the shaft through a slipping clutch whereby when the shaft reaches a limit of swing across a book the wheel can continue its rotation with the finger held against rotation by engagement with the mounting board.

2. Apparatus according to claim 1, and wherein the said radial finger is in the form of a loop of wire.

3. Apparatus according to claim 1 wherein the said slipping clutch comprises a spring washer frictionally engaging the finger and a threaded nut whereby the force between the washer and the finger can be adjusted.

4. Apparatus according to claim 1, wherein the mounting board has a curved member upstanding therefrom which is engaged by the shaft when traversing a central region of a book whereby the said friction-wheel is lifted from the book.

* * * * *